United States Patent [19]

Chayes

[11] 4,041,907

[45] Aug. 16, 1977

[54] SPACER ARRANGEMENT FOR STEAM GENERATOR

[75] Inventor: Norman Chanine Chayes, Bloomfield, Conn.

[73] Assignee: Combustion Engineering, Inc., Windsor, Conn.

[21] Appl. No.: 710,485

[22] Filed: Aug. 2, 1976

[51] Int. Cl.[2] ..... F22B 37/24

[52] U.S. Cl. ..... 122/510; 122/476

[58] Field of Search ..... 122/476, 478, 510; 165/162

[56] References Cited

U.S. PATENT DOCUMENTS

| | | | |
|---|---|---|---|
| 2,803,227 | 8/1957 | Marshall | 122/510 X |
| 2,897,794 | 8/1959 | Otto et al. | 122/510 X |
| 2,976,857 | 3/1961 | Herold | 122/478 |
| 3,026,858 | 3/1962 | Fleischer | 122/510 |
| 3,055,348 | 9/1962 | Brash | 122/510 |
| 3,164,137 | 1/1965 | Liessenberg | 122/510 |

*Primary Examiner*—Kenneth W. Sprague
*Attorney, Agent, or Firm*—Edward L. Kochey, Jr.

[57] ABSTRACT

An arrangement for a steam cooled spacer tube which restrains movement of pendantly supported superheater division panels of a steam generator. A horizontal portion of the spacer engages the panel and a vertical portion engages a pair of bumped furnace wall tubes at a restraining area. A freely rotatable sleeve surrounds the spacer at the restraining area, and a sleeve surrounds each of the bumped furnace wall tubes.

7 Claims, 3 Drawing Figures

SPACER ARRANGEMENT FOR STEAM GENERATOR

BACKGROUND OF THE INVENTION

This invention relates to steam generators and in particular to a fluid cooled spacer for restraining movement of steam heating surface therein.

A portion of the steam superheating surface in large steam generators is frequently in the form of division panels. These panels are made up of a plurality of parallel tubes which are intermeshed and U-shaped and supported from an upper elevation at or above the roof of the furnace. These panels are widely spaced from one another in the order of 8 feet or 12 feet. The panels are large in the order of 30 feet to 40 feet high and 8 feet wide. Minor gas pressure fluctuations therefore exert considerable forces on the panel causing them to tend to swing from side-to-side.

Since there is concern that the repeated swinging of these panels will cause fatigue cracking near the upper support of these panels it is desirable to restrain these panels to minimize this movement. This has been accomplished through the vehicle of using steam cooled spacers which pass horizontally alongside the panels at a lower elevation. These tubes pass on both sides of the panel and serve to maintain the tubes in the plane of the panel as well as providing a vehicle which when restrained will restrain the movement of the division panels.

Towards the rear of the furnace there are normally secondary superheaters which are more closely spaced than the division panels. These are located at a lower gas temperature zone than the division panels and a transverse steam cooled spacer passes through these secondary superheaters and transversely spaces them. This spacer need not be securely fastened to a wall of the furnace, since it engages a large number of the secondary superheaters. The random gas forces applied to the various pendants will tend to offset one another thereby minimizing transverse movement of the entire group of assemblies. One end of the steam cooled spacer surrounding a group of division panels engages a corresponding secondary superheater, thereby restraining one end of the steam cooled spacer.

The other end of the steam cooled spacer is restrained by engagement with the front furnace wall tubes. A pair of tubes is bumped into the furnace to provide a restraining anchor. The fluid cooled spacer is restrained at the front end through engagement with these anchor tubes. The anchor must be arranged to permit the required differential expansion between the various components. The furnace wall and therefore the bumped anchoring tubes will move down as a functin of the temperature of the furnace walls. The steam cooled spacer will move down as a function of the temperature of the superheater panels, and will also move towards or away from the front wall as a function of not only the expansion of the roof and supporting structure, but also as a function of the rotation of the various division panels due to temperature differences between the inlet and outlet legs thereof.

The anchor must also be designed to take substantial forces. For instance a pressure differential of 1 inch of water on a single panel which is 8 feet $\times$ 30 feet in size, amounts to 18,000 lb. force. It follows that the distance which tubes are bumped into the furnace should be minimized since the bending moment on these tubes increases in direct proportion to the length of the applied force from the furnace wall. Accordingly, it has been the practice to extend the steam cooled spacer to a position closely adjacent to the front wall, and to pass it vertically upward between the anchor tubes. By engaging these anchor tubes in either direction the steam cooled spacer has been restrained at the front end.

The extremely high gas temperature in this area in the order of 2200 F has made it impossible to use conventional structures to perform this function which could be used in a friendlier environment. It was found that by just permitting these tubes to abut one another they wore through rather rapidly. Wearing strips were placed on each of the tubes with the same result. Hardened and specially heat treated wearing strips were added but the life of the anchor structure continued to be low.

It is an object of this invention to provide a spacer tube arrangement and an anchor structure which will function to restrain movement of the division panels and which will have a long life. The vertical portion of the fluid cooled spacer tube has a freely rotatable sleeve mounted thereon at the elevation where the tube contacts the front wall anchor tube. This freely rotatable sleeve is supported between a lower ring which is welded to the spacer tube and supports the sleeve and an upper ring which is welded to the spacer tube and restrains incidental upward movement of the rotatable sleeve. Since the vertical portion of the spacer tube intersects the bumped furnace wall tubes at two elevations in the restraining area a separate sleeve is supplied at each elevation.

The bumped furnace wall tubes which engage the spacer also have sleeves surrounding them. Since these sleeves are placed on the furnace wall tube before bending it to shape, they are not free to rotate. It has been found that despite the apparent lack of efficacious cooling of these sleeves which are not connected with a solid metal path for heat flow, that they survive in this environment longer than an equivalent thickness of wearing strip material would. It now appears that the restraining phenomena must involve not only direct contact but some sliding motion, and the rotatable sleeve is better able to absorb this movement with less wear. Other objects and advantages of this invention will become apparent as the description proceeds.

DESCRIPTION OF THE PREFERRED EMBODIMENT

Figure 1:
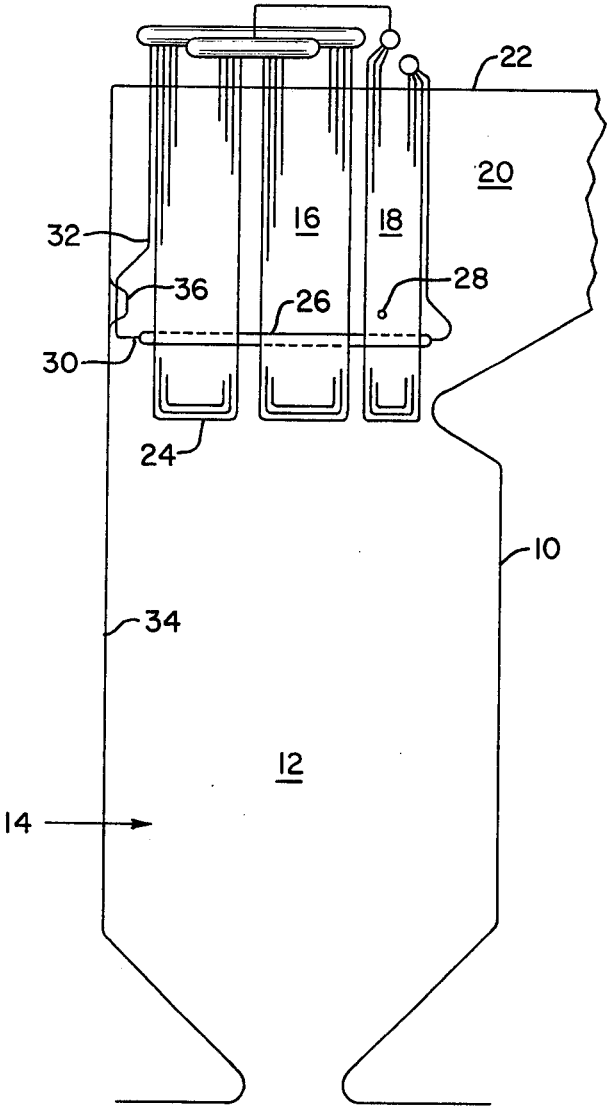
FIG. 1 is a side elevation of the steam generator showing the general arrangement of the fluid cooled spacer.
Figure 3:
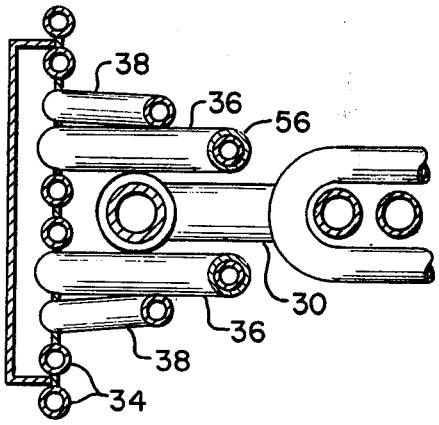
FIG. 3 is a plan view of FIG. 2.
Figure 2:
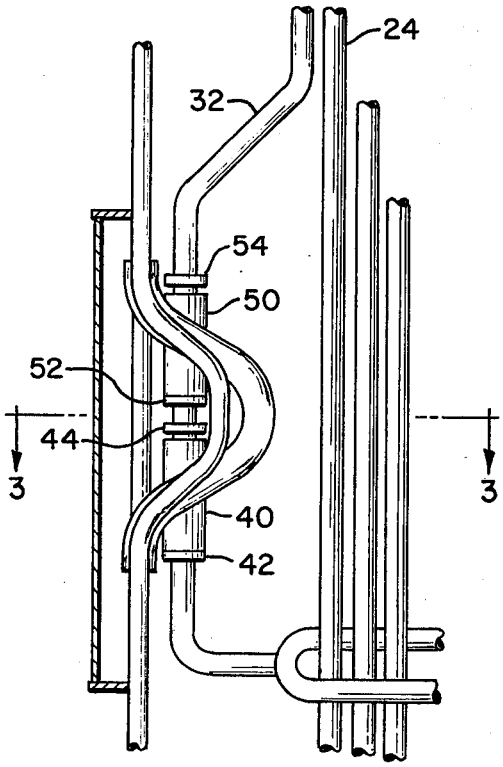
FIG. 2 is a detailed side elevation of the anchor location.

Steam generator 10 includes a furnace 12 into which fuel 14 is fired. The furnace gases pass upwardly over division panels 16 and secondary superheater 18 exiting through gas duct 20.

The division panels 16 are superheater pendant units supported at roof elevation 22. They are formed of a plurality of U-shaped tubes 24 which are arranged to form a plane transverse to the plane of the front furnace wall. Fluid cooled spacer tubes 26 pass horizontally parallel to the plane of the pendant units and in closely spaced relationship therewith. They pass on each side at a lower elevation with the tubes crossing between division panel sections. These tubes operating as a unit serve to keep the individual tubes of the division panel in line and furthermore offer a structure which will restrain the movement of the division panels when this spacer tube itself is restrained.

A transverse spacer 28 is located in the secondary superheater section 18 engaging a plurality of the secondary superheater units. Since the fluid cooled spacer 26 engages the secondary superheater section 18 the rear end of this spacer is restrained from horizontal movement through the action of the transverse spacer 28.

Towards the front of the unit the horizontal fluid cooled spacer tubes 26 are joined by means of a bifurcate 30 to a vertical fluid cooled tube 32. It is the horizontal restraint of this vertical tube which must be accomplished at a restraining elevation near and slightly above the lower elevation of the horizontal fluid cooled spacer tube 26.

The front furnace wall is formed of a plurality of vertical parallel tubes 34. Anchor tubes 36 are bumped inwardly towards the furnace at a restraining elevation. The term "bumped" is descriptive of the structure wherein the tubes leave the plane of the furnace wall, move into the furnace, and then return to the plane of the furnace wall. It is not meant to be restrictive to the particular method of fabricating these tubes. Since these tubes must accept significant forces in the direction parallel to the plane of the furnace wall it is helpful to also bump in to a limited extent additional furnace wall tubes 38 which increase the ability of the anchor tubes to accept horizontal forces. The extent to which the anchor tubes are bumped into the furnace should be the minimum distance compatible with expected expansion differences and assurance of continued intermeshing with the vertical fluid cooled tube 32, but as small as possible to minimize the bending force on the anchor tubes 36.

It can be seen that the vertical tube intersects the anchor tube at two elevations within the restraining elevation area. At the lower of these two elevations a lower freely rotatable sleeve 40 surrounds the tube and is supported by ring 42 which is welded to the vertical tube. An upper ring 44 is also welded to the tube to prevent incidental upward movement of the sleeve. The rings 42 and 44 must be of a material that is compatible with the vertical tube since they must be welded thereto. The rotatable sleeve, however, may be of any material suitable for the high temperature duty and the wear which will occur. For instance, if the tube is carbon steel the rings should be of ferritic material while the sleeve may be of stainless steel. A ferritic stainless steel in this instance would be preferable to minimize expansion differences, but this is not essential. While the tube itself is of austenitic stainless steel all the described components may be of the same material.

At the upper point of intersection within the restraining elevation area an upper freely rotating sleeve 50 is supported on a welded ring 52 and restrained from vertical movement by an upper ring 54. The bumped anchor tubes 36 are each encased in a surrounding tubular sleeve 56 the minimum length of the sleeve should be such that it contacts both of the freely rotatable sleeves 40 and 50. In essentially all cases the furnace wall tubes are of carbon steel or 1¼chrome steel. A stainless steel, however, should be used for the surrounding sleeve because of the higher temperature level at which it operates.

What is claimed is:

1. A spacer tube arrangement for a steam generator having, a furnace, vertical tubes forming a planular wall of said furnace, and a tubular superheater pendant unit supported from an upper elevation and forming a plane transverse to the plane of the wall, comprising:

a. a pair of said vertical tubes bumped into the furnace at a restraining elevation area;

b. fluid cooled spacer tubes passing horizontally parallel to the plane of said pendant units in closely spaced relationship therewith and on each side thereof at a lower elevation below said restraining elevation;

c. a vertical fluid cooled tubular means in series fluid flow relationship with said spacer tubes and passing vertically between said pair of vertical tubes; and d. a freely rotatable sleeve surrounding said vertical fluid cooled tubular means at said restraining elevation area.

2. An apparatus as in claim 1 having also a bifurcate, said bifurcate joining said fluid cooled spacer tubes and said vertical fluid cooled tubular means.

3. An apparatus as in claim 1 having also a lower ring welded to said vertical fluid cooled tubular means immediately below said freely rotatable sleeve, whereby said freely rotatable sleeve is vertically supported by said lower ring.

4. An apparatus as in claim 3 having also an upper ring welded to said vertical fluid cooled tubular means at a location immediately above said freely rotatable sleeve, whereby said upper ring restrains said freely rotatable sleeve from upward movement.

5. An apparatus as in claim 1 having also a pair of tubular sleeves, each of said tubular sleeves encasing each of said pair of vertical tubes bumped into the furnace at the restraining elevation area.

6. An apparatus as in claim 1 wherein said vertical fluid cooled tubular means is of ferritic steel and said freely rotatable sleeve is of stainless steel.

7. An apparatus as in claim 1 having a second freely rotatable sleeve, and wherein said vertical fluid cooled tubular means intersects said pair of vertical tubes bumped into the furnace at two elevations within the restraining elevation area, one of said freely rotatable sleeves being located at each elevation.

* * * * *